US007911423B2

(12) United States Patent
Kim et al.

(10) Patent No.: US 7,911,423 B2
(45) Date of Patent: Mar. 22, 2011

(54) ORGANIC ELECTRO LUMINESCENCE DEVICE

(75) Inventors: Seong-Gyun Kim, Seoul (KR); Du-Hwan Oh, Chungeheongbuk-do (KR)

(73) Assignee: LG Display Co., Ltd., Seoul (KR)

( * ) Notice: Subject to any disclaimer, the term of this patent is extended or adjusted under 35 U.S.C. 154(b) by 967 days.

(21) Appl. No.: 10/963,583

(22) Filed: Oct. 14, 2004

(65) Prior Publication Data

US 2005/0243033 A1 Nov. 3, 2005

(30) Foreign Application Priority Data

Apr. 30, 2004 (KR) ..... 10-2004-0030605

(51) Int. Cl.
*G09G 3/32* (2006.01)

(52) U.S. Cl. ..... 345/76; 345/77

(58) Field of Classification Search ..... 345/76–83
See application file for complete search history.

(56) References Cited

U.S. PATENT DOCUMENTS 6,501,449 B1 * 12/2002 Huang ..... 345/82
6,693,388 B2 * 2/2004 Oomura ..... 315/169.3
6,753,655 B2 * 6/2004 Chen et al. ..... 315/169.3
6,859,193 B1 * 2/2005 Yumoto ..... 345/82
2002/0180369 A1 * 12/2002 Koyama ..... 315/169.1
2004/0150595 A1 * 8/2004 Kasai ..... 345/82
2005/0151705 A1 * 7/2005 Fish ..... 345/76
2006/0158400 A1 * 7/2006 Masumoto et al. ..... 345/78

FOREIGN PATENT DOCUMENTS

CN 1487491 A 4/2004
JP 2003-316317 11/2003

OTHER PUBLICATIONS

Akira Yumoto, et al. "Pixel-Driving Methods for Large-Sized Poly-Si AM-OLED Displays." *Asia Display*. pp. 1395-1398, (2001).

* cited by examiner

*Primary Examiner* — Amr Awad
*Assistant Examiner* — Michael Pervan
(74) *Attorney, Agent, or Firm* — Morgan, Lewis & Bockius LLP

(57) ABSTRACT

An organic electro luminescence device includes first, second, and third switching elements connected in series with each other, the first switching element controlled by a first signal, and the second and third switching elements controlled by a second signal, the second signal being different from the first signal, a first driving element connected to a power source, a storage capacitor, and the first, second and third switching elements, and a second driving element connected to the power source, the storage capacitor, an organic light emitting diode, and the third switching element.

19 Claims, 13 Drawing Sheets

ORGANIC ELECTRO LUMINESCENCE DEVICE

The present application claims the benefit of Korean Patent Application No. 2004-0030605 filed in Korea on Apr. 30, 2004, which is hereby incorporated by reference.

BACKGROUND OF THE INVENTION

1. Field of the Invention

The present invention relates to a display device, and more particularly, to an organic electro luminescence device that has an improved image quality.

2. Discussion of the Related Art

In general, an organic electro luminescence device, which also is referred to as an organic light emitting diode (OLED) device, includes a plurality of pixels and an organic light emitting diode in each of the pixels. Each of the organic light emitting diodes has a cathode electrode injecting electrons, an anode electrode injecting holes, and an organic electro-luminescence layer between the cathode and anode electrodes. Each of the organic light emitting diodes generally has a multi-layer structure of organic thin films formed between the anode electrode and the cathode electrode. When a forward current is applied to the organic thin films, electron-hole pairs (often referred to as excitons) are combined in the organic thin films as a result of a P-N junction between the anode electrode and the cathode electrode. The electron-hole pairs have a lower energy when combined together than when they were separated. Thus, the resultant energy gap between the combined and separated electron-hole pairs is converted into light by an organic electro-luminescent layer. In other words, the organic electro-luminescent layer emits the energy generated due to the recombination of electrons and holes in response to an applied current.

Thus, organic electro luminescence devices do not need an additional light source. In addition, organic electro luminescence devices are thin, light weight, and energy efficient, and have a low power consumption, high brightness, and short response time. Because of these advantageous characteristics, the organic electro luminescence devices are regarded as a promising candidate for various next-generation consumer electronic appliances, such as mobile communication devices, personal digital assistance (PDA) devices, camcorders, and palm PCs. Also, the fabrication of organic electro luminescence devices is a relatively simple process, thereby reducing fabrication costs.

An organic electro luminescence device is categorized as a passive matrix type or an active matrix type. The passive matrix type organic electro luminescence device has a relatively simple structure and fabrication process, but requires higher power in comparison to the active matrix type. In addition, the passive matrix type organic electro luminescence device has a larger size and has a poor aperture ratio as the bus lines therein increase. On the contrary, in comparison to the passive matrix type, the active matrix type organic electro luminescence device provides a higher display quality with higher luminosity.

FIG. 1 is a schematic diagram of an active matrix type organic electro luminescence device according to the related art. In FIG. 1, an active matrix type organic electro luminescence device includes a plurality of scan lines S1 to Sm along a first direction, and a plurality of data lines D1 to Dn along a second direction intersecting the scan lines S1 to Sm, thereby defining a plurality of pixel regions. An organic light emitting diode E, a switching thin film transistor (TFT) P1, a driving TFT P2, and a capacitor C1 are formed within each of the pixel regions. The switching TFT P1 and the driving TFT P2 are p-type metal oxide semiconductor (PMOS) transistors. In particular, a gate and a source of the switching transistor P1 are respectively connected to one of the scan lines S1 to Sm and one of the data lines D1 to Dn. A drain of the switching transistor P1 is connected to the capacitor C1. A source and a drain of the driving transistor P2 are connected to a power $V_{DD}$ and an anode of the organic light emitting diode E, respectively. Further, a gate of the driving transistor P2 is connected to the drain of the switching transistor P1.

In addition, when a scan signal is applied to the gate of the switching transistor P1 through the scan line S, the switching transistor P1 is turned on. At this time, a data voltage applied to the data line D is transmitted to the capacitor C1 through the switching transistor P1, thereby charging the capacitor C1. Thereafter, the driving transistor P2 is operated, and then the charge stored in the capacitor C1 determines current level that flows into the organic light emitting diode E through the driving transistor P2.

As a result, the organic light emitting diode E can display a gray scale between black and white. In particular, the scan lines S1 to Sm are sequentially driven to turn on the switching transistors P1 connected to the corresponding scan line, and then data voltages are applied to the desired data lines to operate the respective organic light emitting diode E.

FIG. 2 is a circuit diagram of a pixel region of an organic electro luminescence device according to the related art. As shown in FIG. 2, four transistors, instead of two transistors shown in FIG. 1, are formed in a pixel region. The four-transistor structure shown in FIG. 2 is often referred to as 4-TFT/1-CAP. In FIG. 2, a data line D and a power line $V_{DD}$ are formed along a first direction, and a first scan line Sc1 and a second scan line Sc2 are formed along a second direction intersecting the data line D and the power line $V_{DD}$, thereby defining the pixel region. First and second driving TFTs M1 and M2, a organic light emitting diode E, first and second switching TFTs SW1 and SW2, and a storage capacitor $C_{st}$ also are formed in the pixel region.

The first and second driving TFTs M1 and M2 receive a power voltage from the power line $V_{DD}$, and the second driving TFT M2 is connected to the organic light emitting diode E. The first and second switching TFTs SW1 and SW2 receive scan signals from the first and second scan lines Sc1 and Sc2, respectively. The first switching TFT SW1 receives a data signal from the data line D, and the second switching TFT SW2 receives output signals from the first switching and driving TFTs SW1 and M1. The storage capacitor $C_{st}$ is connected between the power line $V_{DD}$ and gates of the first and second driving TFTs M1 and M2, and supplies a voltage to the gates of the first and second driving TFTs M1 and M2 to maintain the voltage signals thereof.

The first switching TFT SW1 is an n-type metal oxide semiconductor (NMOS) transistor, and the second switching TFT SW2, the first driving TFT M1, and the second driving TFT M2 are PMOS transistors. Further, the first and second driving TFTs M1 and M2 form a current mirror circuit, such that the drain current of the first driving TFT M1 is proportional to the drain current of the second driving TFT M2 irrespective of a load resistance value. As a result, the current mirror circuit controls the organic light emitting diode E, such that a mirror ratio (MR) of the second driving TFT M2 and the first driving TFT M1 controls the current level being applied to the organic light emitting diode E.

FIG. 3 is a graph showing scan signals applied to the scan lines Sc1 and Sc2 of FIG. 2, and FIGS. 4A and 4B are equivalent circuit diagrams illustrating ON and OFF states of the device of FIG. 2. As shown in FIG. 3, a high-state scan signal is applied to the first scan line Sc1 and a low-state scan signal is applied to the second scan line Sc2 during a pre-charging period. In addition, the low-state scan signal of the second scan line Sc2 is switched to a high-state at the end of a $C_{st}$ charging period, before the high-state scan signal of the first scan line Sc1 is switched to a low-state.

When the high-state scan signal is applied to the first scan line Sc1 and when the low-state scan signal is applied to the second scan line Sc2 during the pre-charging period and during the $C_{st}$ charging period, the first and second switching TFTs SW1 and SW2 are turned on. As shown in FIG. 4A, when the first and second switching TFTs SW1 and SW2 are turned on, the first driving TFT M1 functions as a diode. Therefore, a current $I_{OLED}$ applied to the second driving TFT M2 is controlled by a data current $I_{data}$ of the first driving TFT M1. For example, if the first and second driving TFTs M1 and M2 are in a mirror ratio (MR) of 5:1 and if the OLED E needs a current of 1 microampere (μA) to display a white color, then a current of 1 microampere (μA) can be applied to the organic light emitting diode E through the second driving TFT M2 when a current of 5 microamperes (μA) is sunk through the first driving TFT M1.

In addition, as shown in FIG. 4B, the pixel has a current sink method, such that gate voltages Vg_m1 and Vg_m2 of the first and second driving TFTs M1 and M2 have the same value irrespective of elements of the neighboring pixels. Therefore, the pixel having the structure of FIG. 2 can improve the image quality, and the charge stored in the storage capacitor $C_{st}$ can maintain the voltage of the voltage signal on the gates of the driving TFTs M1 and M2. Additionally, although the switching TFTs SW1 and SW2 are turned OFF, the current level flowing to the organic light emitting diode E remains constant during one frame.

FIG. 5 illustrates parasitic capacitances in the pixel of FIG. 2. As shown in FIG. 5, a first parasitic capacitance C1 is between the first switching TFT SW1 and the gates of the first and second driving TFTs M1 and M2. A second parasitic capacitance C2 is between the second switching TFT SW2 and the gates of the first and second driving TFTs M1 and M2. As a result, after switching off the first and second switching TFTs SW1 and SW2, a kick back phenomenon occurs. First and second kick back currents caused by the first and second parasitic capacitances C1 and C2 can be calculated by the following equations (1) and (2).

$$\Delta Ip1 = \frac{C1}{C1 + C2 + Cst}\Delta I1 \quad \text{Equation (1)}$$

$$\Delta Ip2 = \frac{C2}{C1 + C2 + Cst}\Delta I2 \quad \text{Equation (2)}$$

where C1 is the first parasitic capacitance between the first switching TFT SW1 and the gates of the first and second driving TFTs M1 and M2, and C2 is the second parasitic capacitance between the second switching TFT SW2 and the gates of the first and second driving TFTs M1 and M2. Furthermore, ΔI1 and ΔI2 represent current values applied to the first and second parasitic capacitors C1 and C2.

FIG. 6 is a simulation graph illustrating kick back currents occurring in the pixel of FIG. 2. As shown in FIG. 6, when the second and first switching TFTs SW2 and SW1 (shown in FIG. 2) are sequentially turned off, the parasitic capacitances C1 and C2 induce a voltage drop producing the current drop at portions A and B. The overall kick back current ΔIp may be about 27.1% of the total current. As a result, the organic electro luminescence device displays abnormal lines during operation.

FIG. 7 is a circuit diagram of a pixel of another organic electro luminescence device according to the related art. In FIG. 7, the pixel includes a data line D, a power line $V_{DD}$, first and second driving TFTs M1 and M2, a organic light emitting diode E, first and second switching TFTs SW1 and SW2, first and second scan lines Sc1 and Sc2, and a storage capacitor $C_{st}$. The first and second driving TFTs M1 and M2 receive a power voltage from the power line $V_{DD}$. The second driving TFT M2 is connected to the organic light emitting diode E.

The first and second switching TFTs SW1 and SW2 receive scan signals from the first and second scan lines Sc1 and Sc2, respectively. The first switching TFT SW1 is connected to the data line D to receive a data signal from the data line D. The second switching TFT SW2 is connected to the first switching and driving TFTs SW1 and M1. The storage capacitor $C_{st}$ is located between the power line $V_{DD}$ and a drain of the second switching TFT SW2, and supplies a voltage to the gate of the second driving TFTs M2.

Unlike the pixel shown in FIG. 2, the first and second switching TFTs SW1 and SW2 and the first and second driving TFTs M1 and M2 of FIG. 7 are PMOS transistors. An anode of the organic light emitting diode E is connected to the second driving TFT M2.

The first and second driving TFTs M1 and M2 has a connection of current mirror circuit where the drain current of the first driving TFT M1 is proportional to the drain current of the second driving TFT M2 irrespective of the load resistance value. In FIG. 7, the anode of the organic light emitting diode E is connected to a drain of the second driving TFT M2, such that the current mirror circuit controls the data value applied to the organic light emitting diode E. As a result, the mirror ratio (MR) of the second driving TFT M2 and the first driving TFT M1 controls the current level being applied to the organic light emitting diode E.

FIG. 8 is a graph showing scan signals applied to the scan lines Sc1 and Sc2 of FIG. 7, and FIGS. 9A and 9B are equivalent circuit diagrams illustrating ON and OFF states of the switching elements of FIG. 7. As shown in FIG. 8, a low-state scan signal is applied to both the first and second scan lines Sc1 and Sc2 during a pre-charging period. Then, a high-state scan signal is applied to the second scan line Sc2 at the end of a $C_{st}$ charging period, before another high-state scan signal is applied to the first scan line Sc1.

As shown in FIG. 9A, when the low-state scan signals are applied to the first and second scan lines Sc1 and Sc2, the first and second switching TFTs SW1 and SW2 are turned ON. Thus, the current sink is formed, gate voltages Vg_m1 and Vg_m2 of the first and second driving TFTs M1 and M2 are the same.

As shown in FIG. 9B, when the first and second switching TFTs SW1 and SW2 are turned OFF, the first and second driving TFTs M1 and M2 receive the different gate voltages. Therefore, the different stresses are imposed on the first and second driving TFTs M1 and M2, and those driving TFTs M1 and M2 express different characteristics. For example, when the first and second switching TFTs SW1 and SW2 are turned OFF, the second gate voltage Vg_m2 of the second driving TFT M2 is the data voltage from the data line D, but the first gate voltage Vg_m1 of the first driving TFT M1 is a difference between a power $V_{DD}$ and a threshold voltage Vth-m1 of the first driving TFT M1 because of the continuous diode connection. Thus, the first and second gate voltages Vg_m1 and Vg_m2 are significantly different from each other. As a result, the organic electro luminescence device still fails to uniformly display images.

FIG. 10 illustrates a parasitic capacitance in the pixel of FIG. 7. As shown in FIG. 10, a parasitic capacitance C3 is formed between the gate of the second driving TFT M2 and a gate terminal of the second switching TFT SW2. As a result, after switching off the first and second switching TFTs SW1 and SW2, a kick back phenomenon occurs. A kick back current caused by the parasitic capacitance C3 can be calculated by the following equation (3).

$$\Delta Ip3 = \frac{C3}{C3 + Cst}\Delta I3 \qquad \text{Equation (3)}$$

where C3 is a parasitic capacitance between the second switching TFT SW2 and the second driving TFT M2, and ΔI3 represents a current value applied to that parasitic capacitor C3.

FIG. 11 is a simulation graph illustrating a kick back current occurring in the pixel of FIG. 7. As shown in FIG. 11, when the second and first switching TFTs SW2 and SW1 (shown in FIG. 7) are sequentially turned off, the parasitic capacitance C3 (shown in FIG. 10) induces a voltage drop producing the current drop at portion A. The overall kick back current ΔIp3 may be about 6.1% of the total current. However, the organic electro luminescence device still fails to uniformly display images because the first and second driving TFTs M1 and M2 receives different electrical stresses as the first and second switching TFTs SW1 and SW2 are turned off.

SUMMARY OF THE INVENTION

Accordingly, the present invention is directed to an organic electro luminescence device that substantially obviates one or more of the problems due to limitations and disadvantages of the related art.

An object of the present invention is to provide an organic electro luminescence device that minimizes an effect of a kick back current.

Another object of the present invention is to provide an organic electro luminescence device that prevents different stresses being imposed on driving thin film transistors, thereby obtaining higher resolution and better image quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, the organic electro luminescence device includes first, second, and third switching elements connected in series with each other, the first switching element controlled by a first signal, and the second and third switching elements controlled by a second signal, the second signal being different from the first signal, a first driving element connected to a power source, a storage capacitor, and the first, second and third switching elements, and a second driving element connected to the power source, the storage capacitor, an organic light emitting diode, and the third switching element.

In another aspect, the organic electro luminescence device includes power and data lines, a first driving TFT connected to the power line, a second driving TFT connected to the power line, an organic light emitting diode connected to the second driving TFT, a first switching TFT connected to the data line, a second switching TFT connected to the first switching TFT and the first driving TFT, a third switching TFT connected to the second switching TFT, the first driving TFT, and the second driving TFT, a storage capacitor connected between the power line and the third switching TFT, a first scan line connected to the first switching TFT, and a second scan line connected to the second switching TFT and the third switching TFT.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 12:
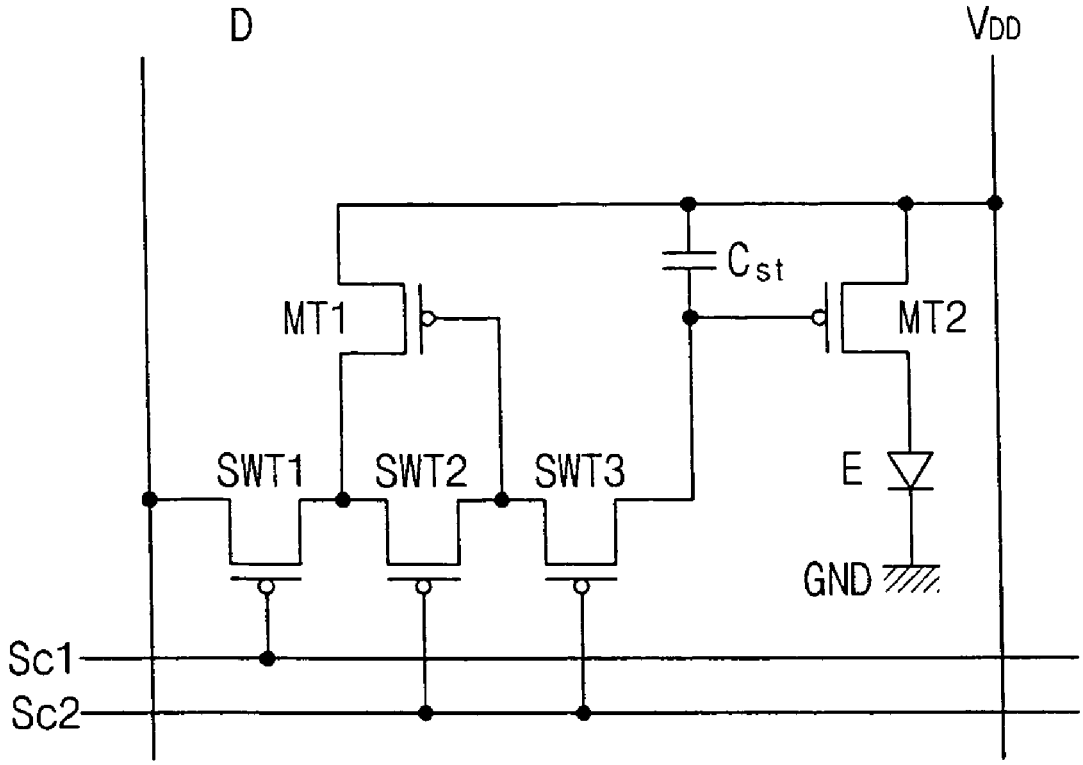
FIG. 12 is an equivalent circuit diagram illustrating one pixel of an organic electro luminescence device according to an embodiment of the present invention.

FIG. 12 is an equivalent circuit diagram illustrating one pixel of an organic electro luminescence device according to an embodiment of the present invention. In FIG. 12, an organic electro luminescence device may include a data line D and a power line $V_{DD}$ along a first direction spaced apart from each other, and first and second scan lines Sc1 and Sc2 along a second direction intersecting the data line D and the power line $V_{DD}$, thereby defining a pixel region. Although only one data line D, one power line $V_{DD}$, one first scan line Sc1, and one second scan line Sc2 are shown, the organic electro luminescence device may include a plurality of the data lines D, power lines $V_{DD}$, the first scan lines Sc1, and the second scan lines Sc2, thereby having a plurality of pixel regions.

In addition, first and second driving thin film transistors MT1 and MT2, an organic light emitting diode E, first to third switching thin film transistors SWT1, SWT1 and SWT3, and a storage capacitor $C_{st}$ may be formed in the pixel region. The first and second driving thin film transistors MT1 and MT2 may form a current mirror circuit and may receive a power voltage from the power line $V_{DD}$. The organic light emitting diode E may connect to a drain of the second driving TFT MT2 and to a ground source GND.

Further, the data line D may be connected to the first switching TFT SWT1 and may apply a data signal to the first switching TFT SWT1. The second switching TFT SWT2 may be connected to both of the first switching and driving TFTs SWT1 and MT1, and the third switching TFT SWT3 may be connected to the second switching TFT SW2 and the first and second driving TFTs MT1 and MT2. The storage capacitor $C_{st}$ may be connected to the power line $V_{DD}$ and to the third switching TFT SWT3. The first scan line Sc1 may be connected to the first switching TFT SWT1 for applying a first scan signal thereto, and the second scan line Sc2 may be connected to the second and third switching TFTs SWT2 and SWT3 for applying a second scan signal thereto. As a result, the second switching TFT SWT2 and the third switching TFT SWT3 may be operated simultaneously.

Figure 13:
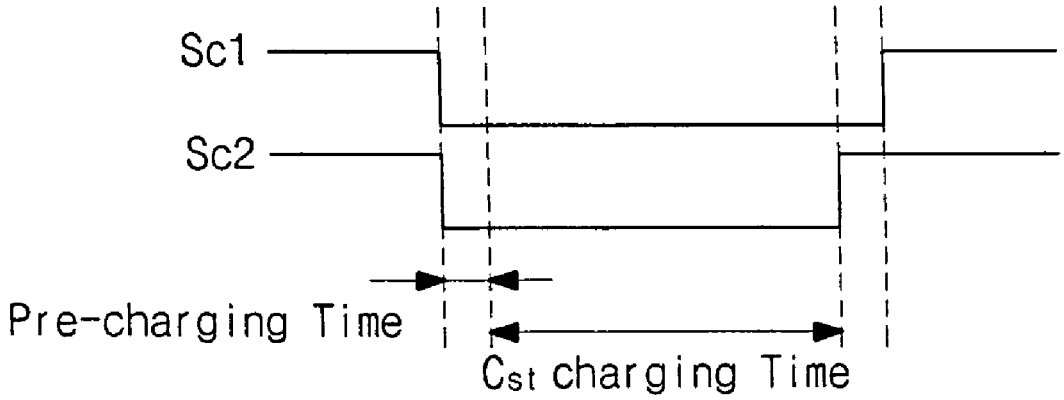
FIG. 13 is a graph showing scan signals applied to the scan lines Sc1 and Sc2 of FIG. 12.
Figure 14A:
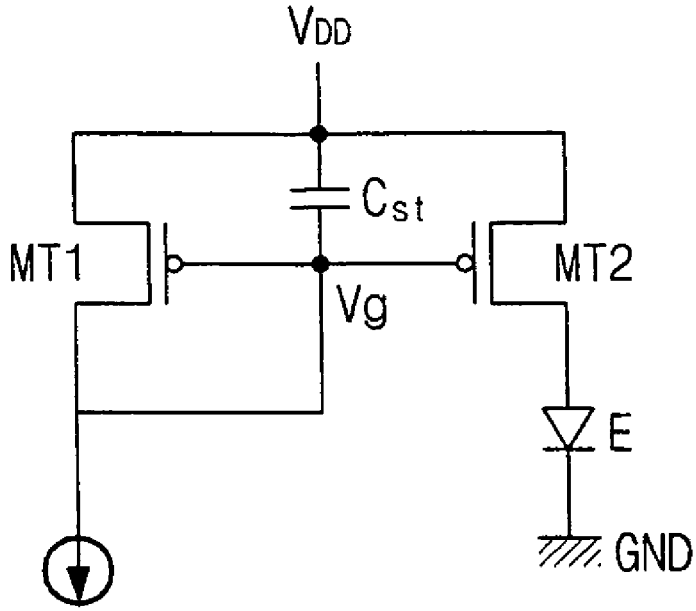
FIGS. 14A and 14B are equivalent circuit diagrams illustrating ON and OFF states of the switching elements of FIG. 12.
Figure 14B:
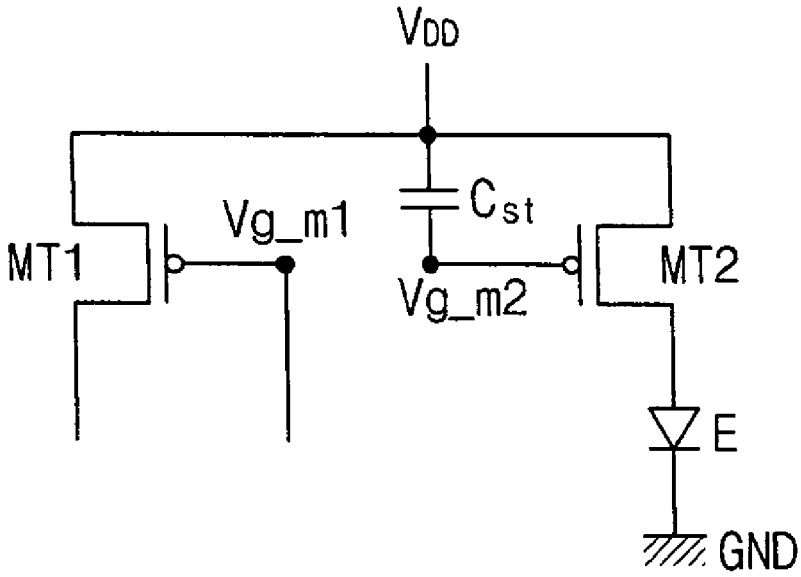

FIG. 13 is a graph showing scan signals applied to the scan lines Sc1 and Sc2 of FIG. 12, and FIGS. 14A and 14B are equivalent circuit diagrams illustrating ON and OFF states of the switching elements of FIG. 12. As shown in FIG. 13, a low-state scan signal may be applied to both the first and second scan lines Sc1 and Sc2 during a pre-charging period. However, a high-state scan signal may be applied to the second scan line Sc2 at the end of a $C_{st}$ charging period, before another high-state scan signal is applied to the first scan line Sc1.

When the low-state scan signals are applied to the first and second scan lines Sc1 and Sc2 during the pre-charging period and during the $C_{st}$ charging period, the first to third switching TFTs SWT1, SWT2 and SWT3 may be turned on. As shown in FIG. 14A, when the first to third switching TFTs SWT1, SWT2 and SWT3 are turned on, the first driving TFT MT1 may function as a diode, and the first and second driving TFTs MT1 and MT2 may form a current mirror.

When the high-state scan signals are applied to the first and second scan lines Sc1 and Sc2, the first to third switching TFTs SWT1, SWT2 and SWT3 may be turned off. As shown in FIG. 14B, although the first, second and third switching TFTs SWT1, SWT2 and SWT3 are switched off, the gate of the first driving TFT MT1 may be floated because the second and third switching TFTs SWT2 and SWT3 are turned off simultaneously. As a result, the first driving transistor MT1 does not form the diode connection and gate voltages Vg_m1 and Vg_m2 of the first and second driving TFTs MT1 and MT2 are about the same. Accordingly, the same stress level is imposed on the first and second driving TFTs MT1 and MT2, thereby avoiding non-uniformity in image quality.

Figure 15:
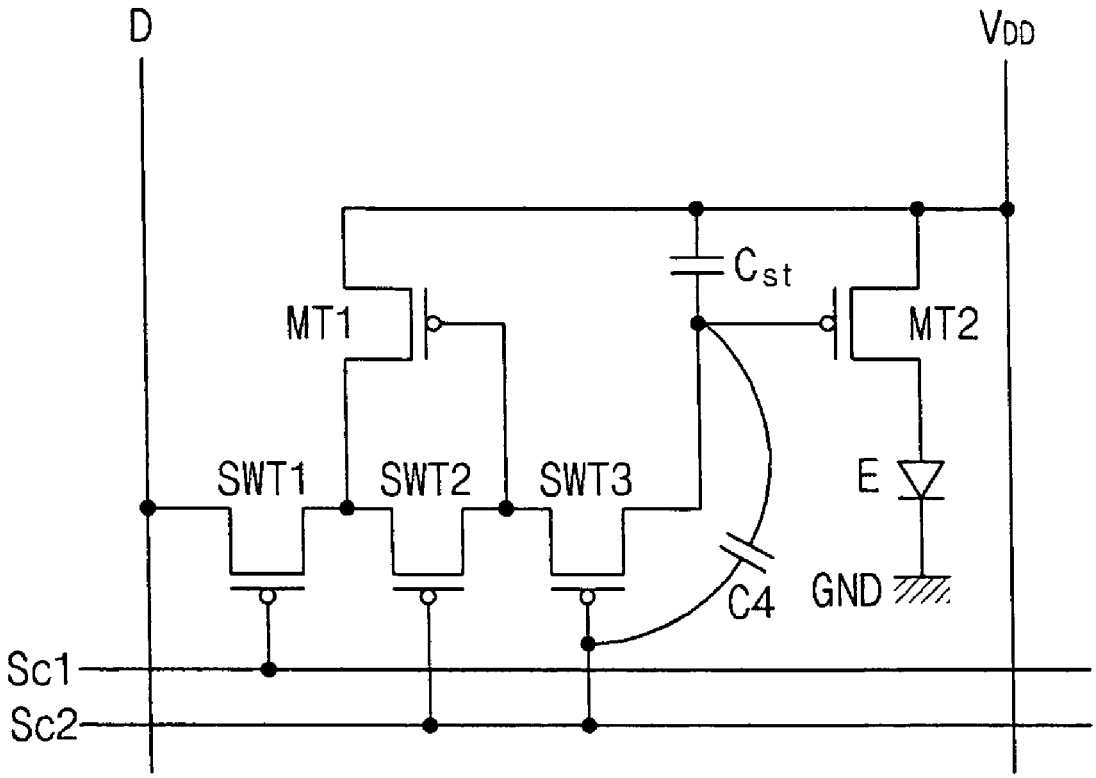
FIG. 15 illustrates a parasitic capacitance in the pixel of FIG. 12.

FIG. 15 illustrates a parasitic capacitance in the pixel of FIG. 12. As shown in FIG. 15, a parasitic capacitance C4 may be considered to be between a gate terminal of the second driving TFT MT2 and a gate terminal of the third switching TFT SWT3, when the third switching TFT SWT3 is turned off. As a result, a kick back current ΔIp may occur, and the kick back current ΔIp may be calculated by the following equation (4).

$$\Delta Ip = \frac{C4}{C4 + Cst}\Delta I4 \qquad \text{Equation (4)}$$

where C4 is a parasitic capacitance between the third switching TFT SWT3 and the second driving TFT MT2, and ΔI4 represents a current value applied to the parasitic capacitor C4. That is, ΔI4 is the electric current applied between the third switching TFT SWT 3 and the gate of the second driving TFT MT2.

Figure 1:
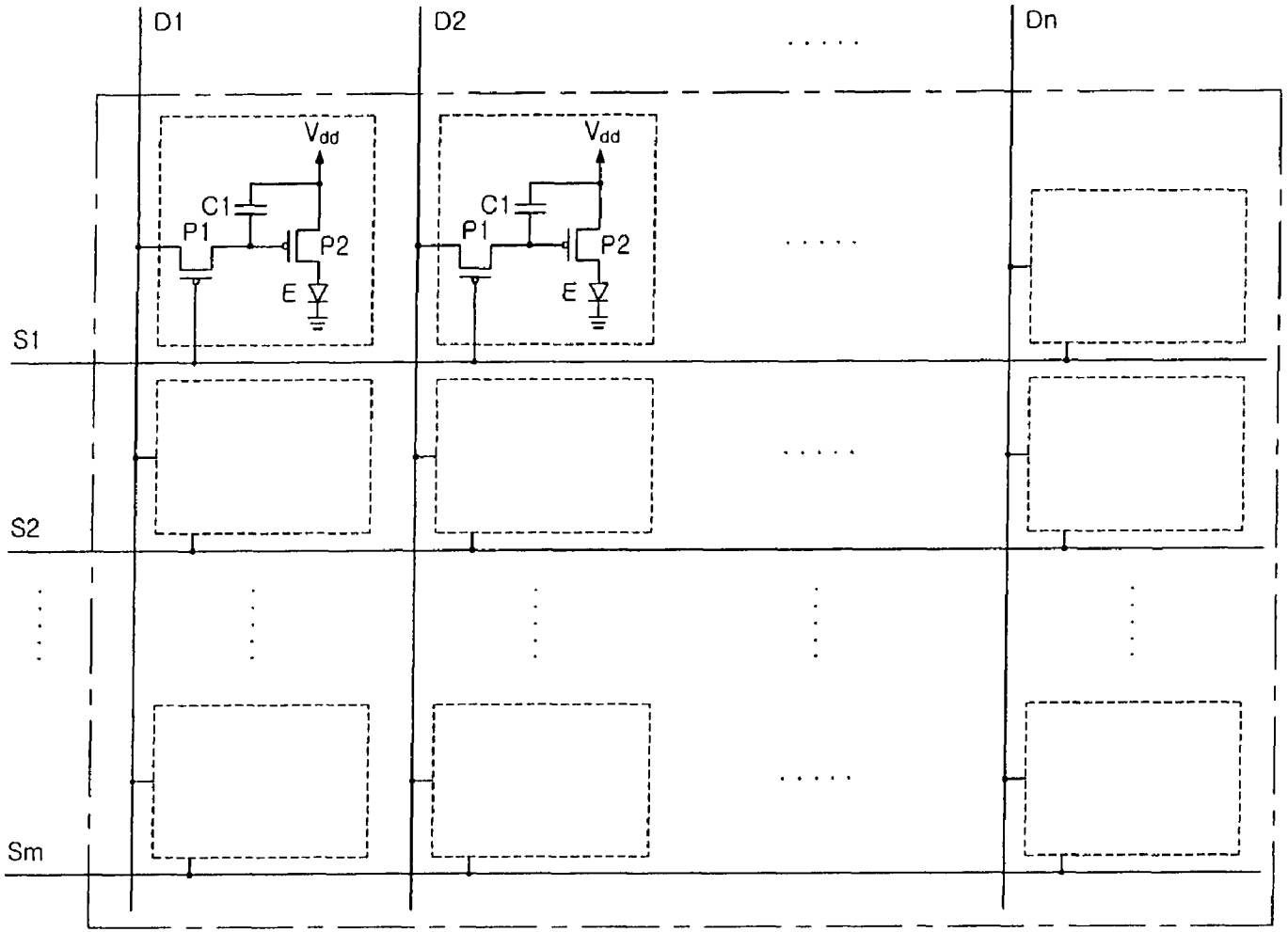
FIG. 1 Related Art
FIG. 1 is a schematic diagram of an active matrix type organic electro luminescence device according to the related art.
Figure 2:
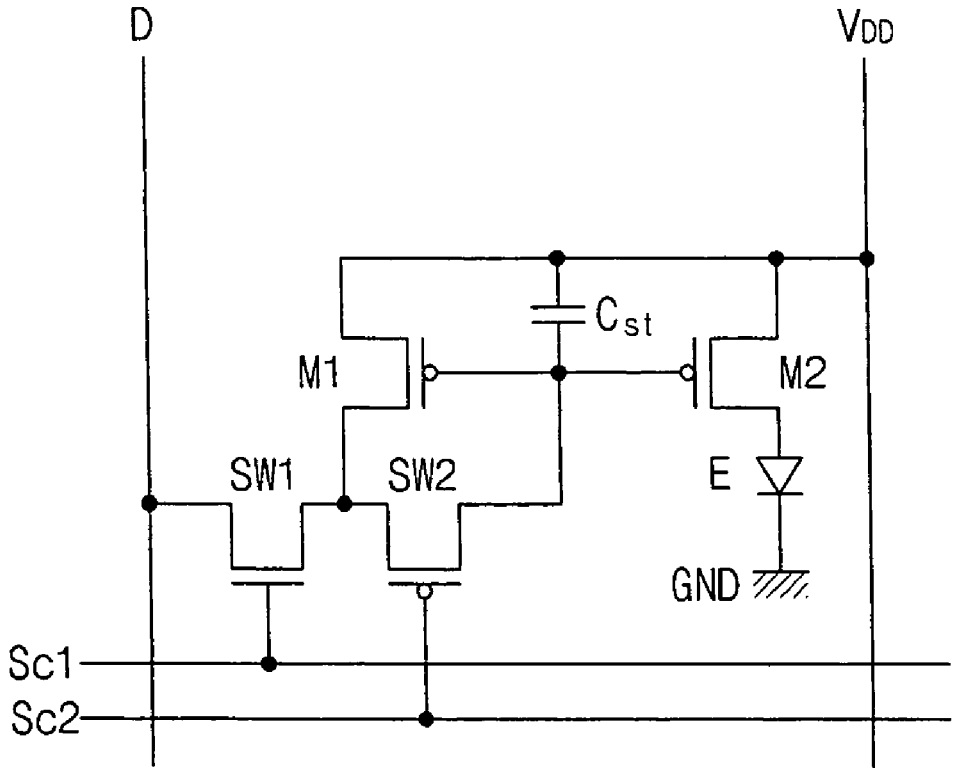
FIG. 2 Related Art
FIG. 2 is a circuit diagram of a pixel region of an organic electro luminescence device according to the related art.
Figure 3:
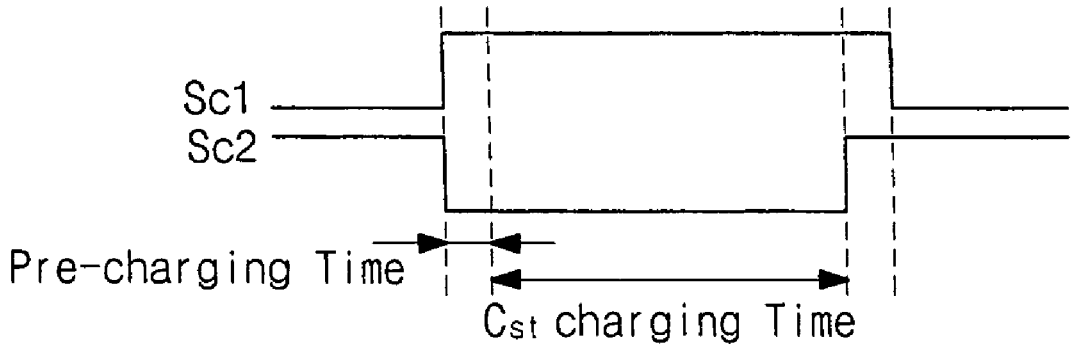
FIG. 3 Related Art
FIG. 3 is a graph showing scan signals applied to the scan lines Sc1 and Sc2 of FIG. 2.
Figure 4A:
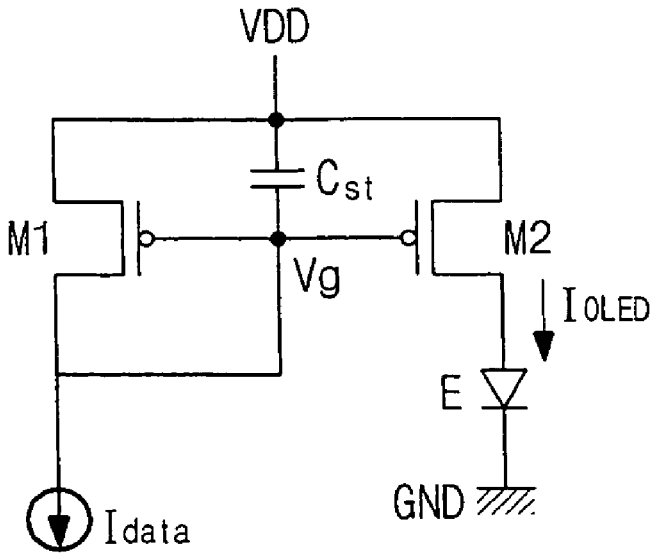
FIG. 4A Related Art
FIGS. 4A and 4B are equivalent circuit diagrams illustrating ON and OFF states of the switching elements of FIG. 2.
Figure 4B:
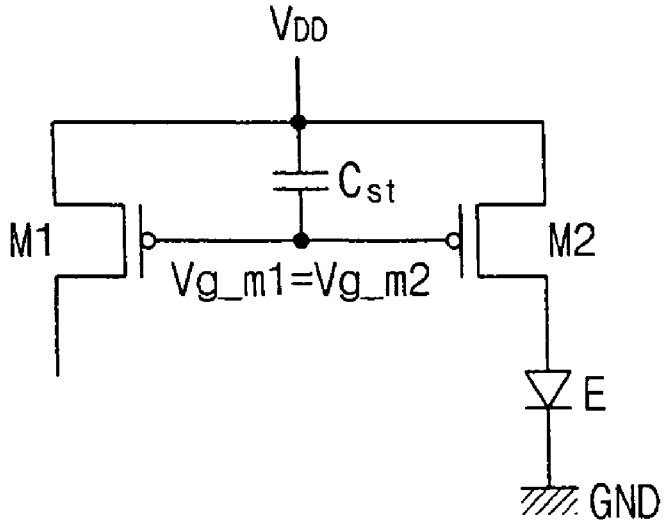
FIG. 4B Related Art
Figure 5:
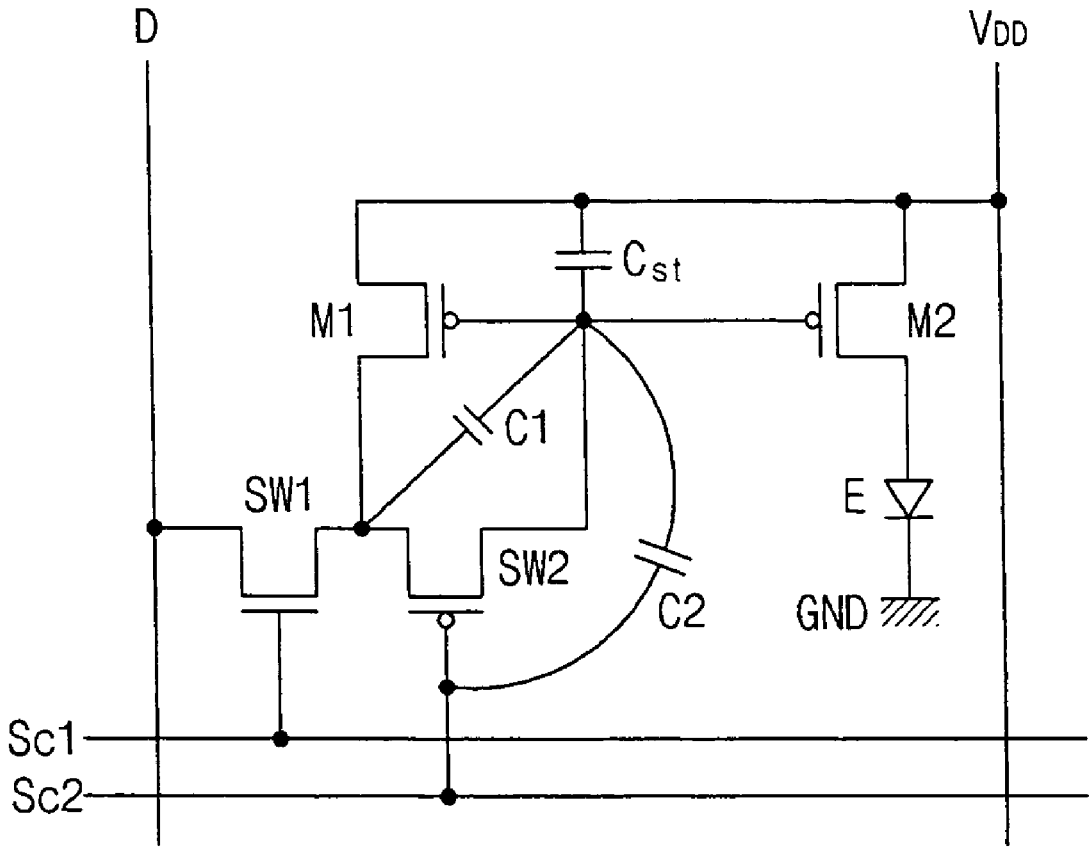
FIG. 5 Related Art
FIG. 5 illustrates parasitic capacitances in the pixel of FIG. 2.
Figure 6:
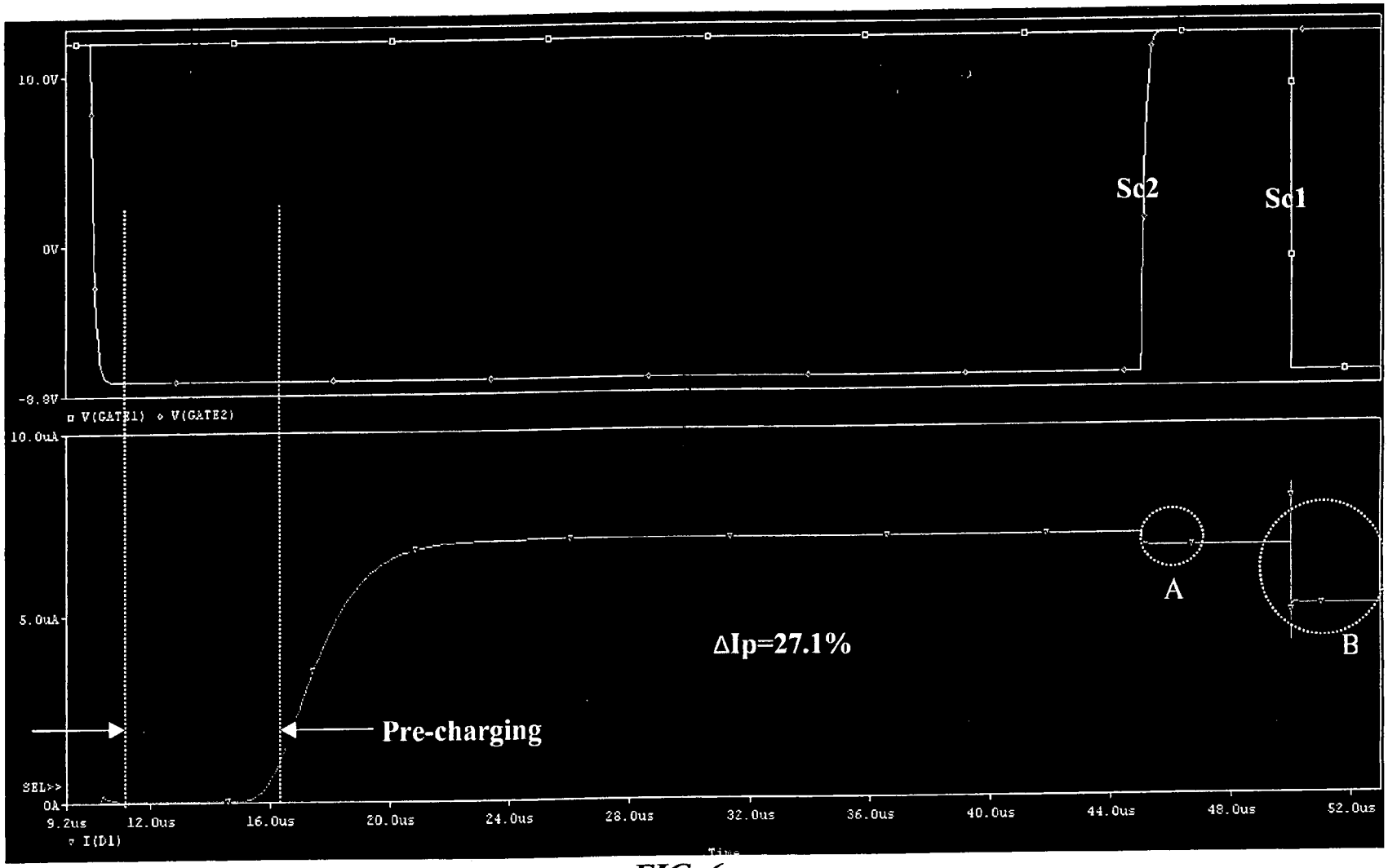
FIG. 6 Related Art
FIG. 6 is a simulation graph illustrating kick back currents occurring in the pixel of FIG. 2.
Figure 7:
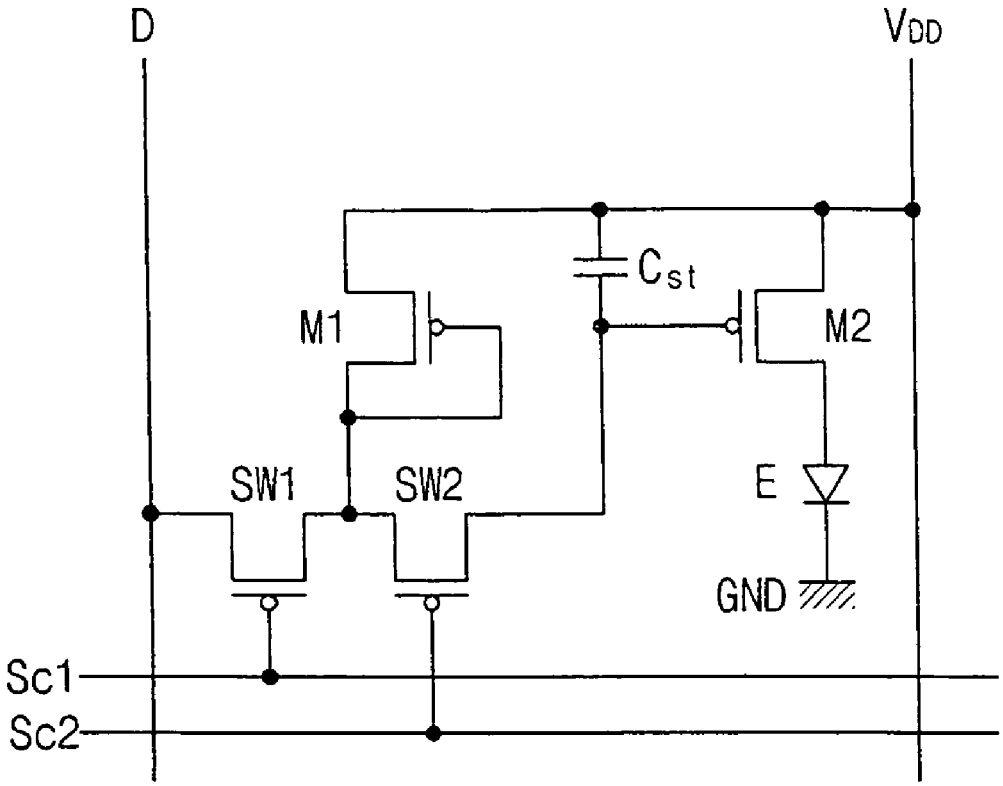
FIG. 7 Related Art
FIG. 7 is a circuit diagram of a pixel of another organic electro luminescence device according to the related art.
Figure 8:
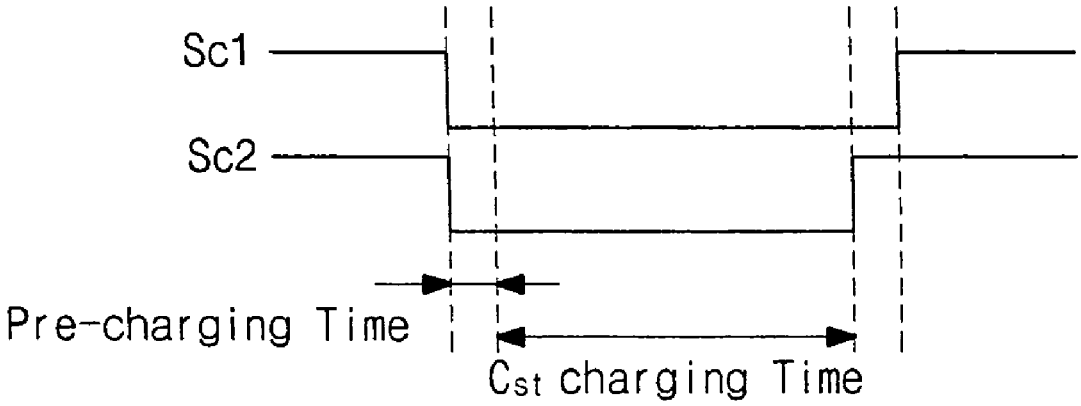
FIG. 8 Related Art
FIG. 8 is a graph showing scan signals applied to the scan lines Sc1 and Sc2 of FIG. 7.
Figure 9A:
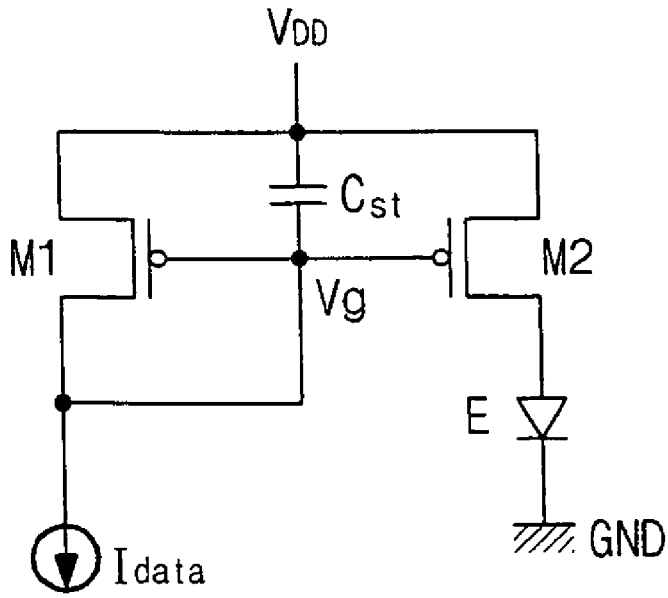
FIG. 9A Related Art
FIGS. 9A and 9B are equivalent circuit diagrams illustrating ON and OFF states of the switching elements of FIG. 7.
Figure 9B:
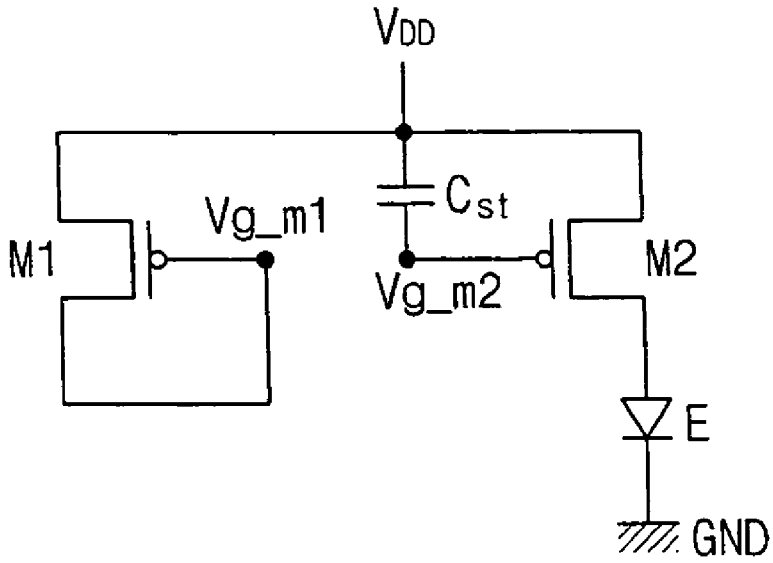
FIG. 9B Related Art
Figure 10:
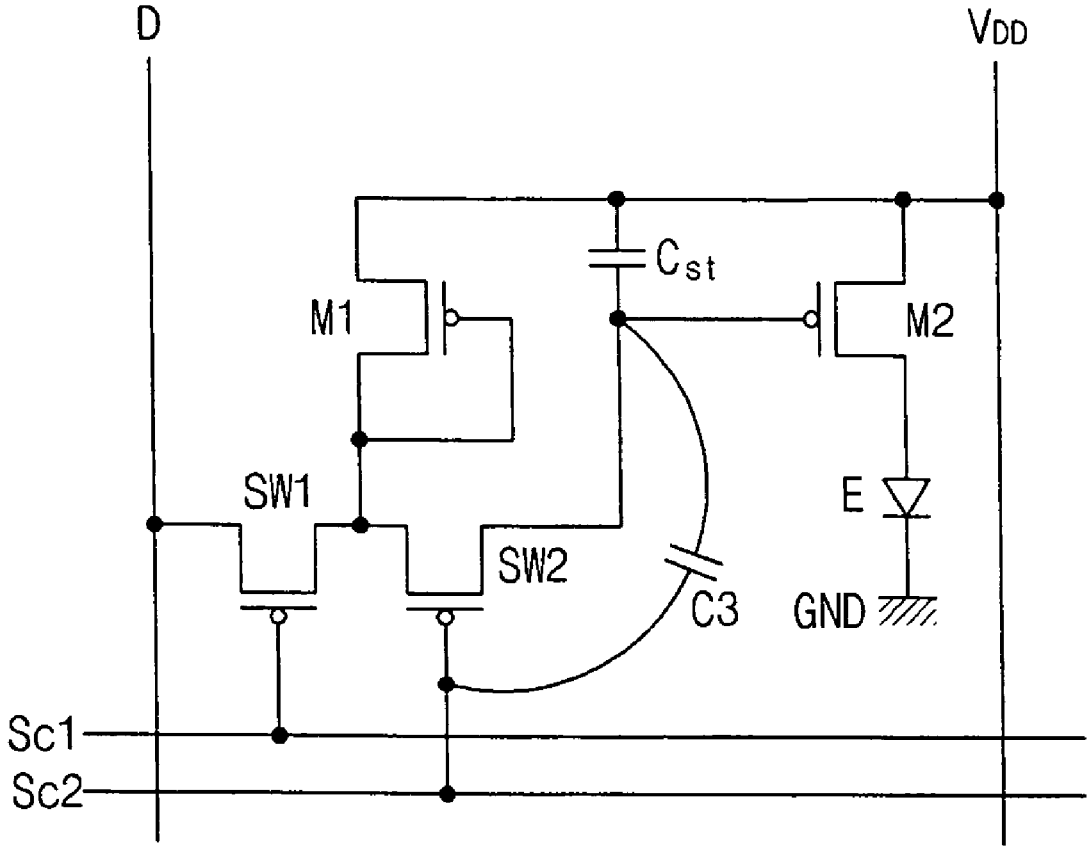
FIG. 10 Related Art
FIG. 10 illustrates a parasitic capacitance in the pixel of FIG. 7.
Figure 11:
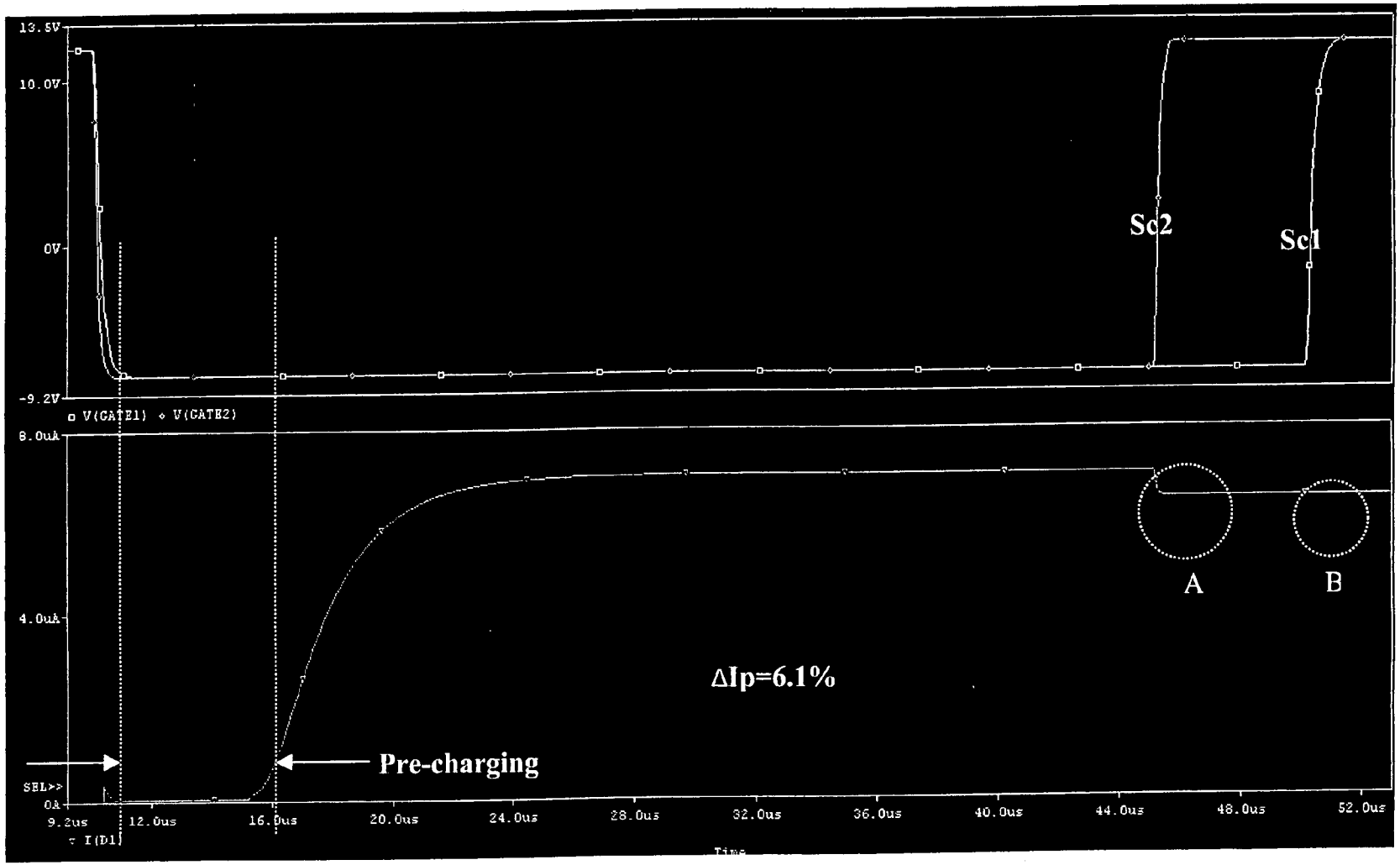
FIG. 11 Related Art
FIG. 11 is a simulation graph illustrating a kick back current occurring in the pixel of FIG. 7.
Figure 16:
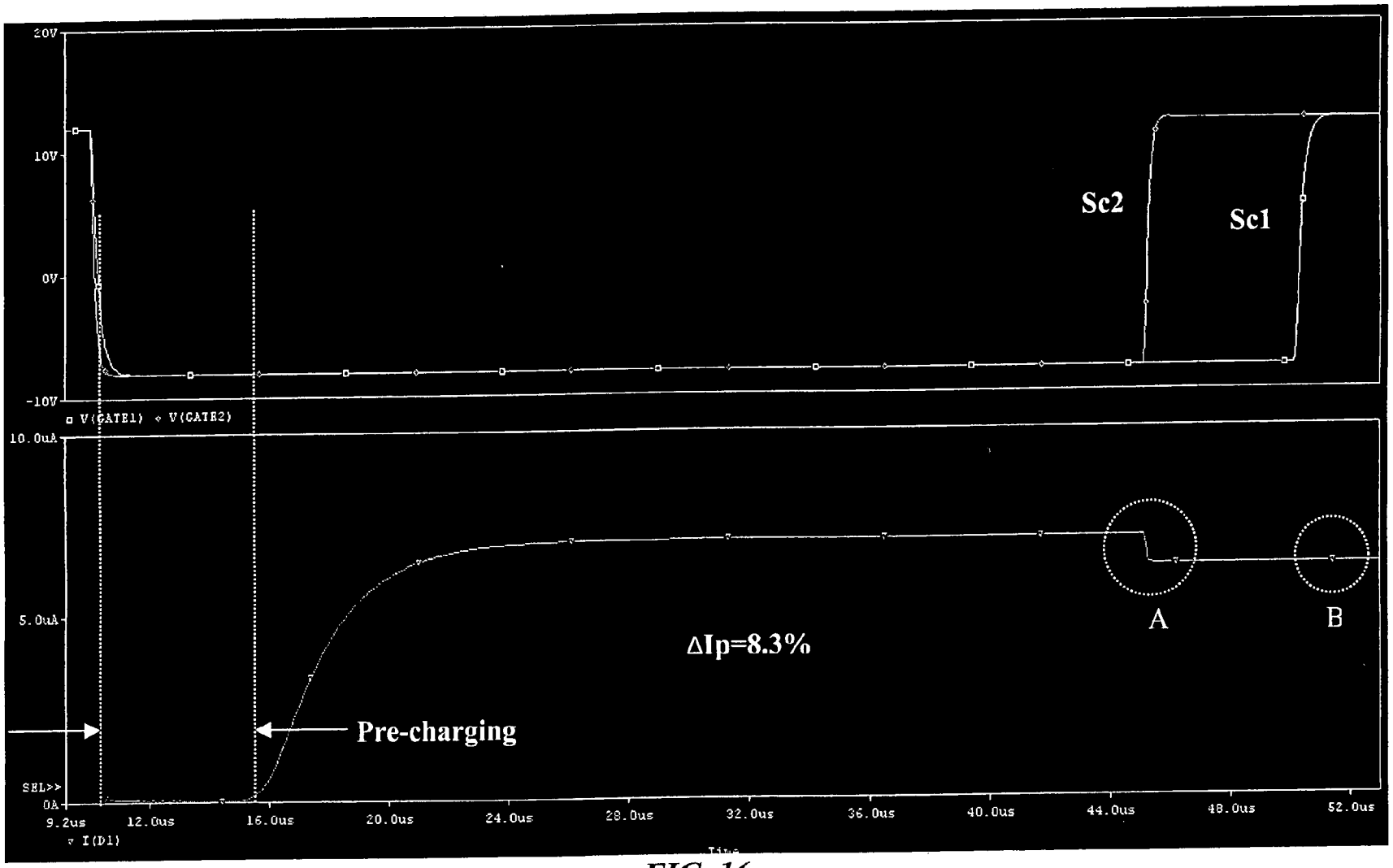
FIG. 16 is a simulation graph illustrating a kick back current occurring in the pixel of FIG. 12.

FIG. 16 is a simulation graph illustrating a kick back current occurring in the pixel of FIG. 12. As shown in FIG. 16, when the high-state scan signal is applied to the second scan line Sc2 resulting the second and third switching TFTs SWT2 and SWT3 (shown in FIG. 12) being turned off, a kick back current ΔIp may occur at circle A. The kick back current ΔIp may be about 8.3% of the total current, which is close to that described with reference to FIG. 11. In particular, the difference between the kick back current ΔIp of 8.3% shown in FIG. 16 and the kick back current ΔIp3 of 6.1% shown in FIG. 11 is about 2% and is relatively immaterial, especially in light of the similar stress levels being experienced at the gates of the first and second driving TFT MT1 and MT2. As a result, the combination of the first to third switching TFTs SWT1, SWT2 and SWT3 may protect the first and second driving TFTs MT1 and MT2 from experiencing different stress levels and may minimize an effect of a kick back current.

Thus, the organic electro luminescence device according to an embodiment of the present invention avoid different stress level being imposed on the driving TFTs, thereby uniformly displaying images. Moreover, the organic electro luminescence device according to an embodiment of the present invention may minimize an effect of a kick back current due to a parasitic capacitance between the driving TFT and the switching TFT. Therefore, the organic electro luminescence device according to an embodiment of the present invention provides higher resolution and better image quality.

It will be apparent to those skilled in the art that various modifications and variations can be made in the organic electro luminescence device of the present invention without departing from the sprit or scope of the invention. Thus, it is intended that the present invention covers the modifications and variations of this invention provided they come within the scope of the appended claims and their equivalents.

What is claimed is:

1. An organic electro luminescence device, comprising:

first, second, and third switching elements connected in series with each other, the first switching element controlled by a first signal, and the second and third switching elements controlled by a second signal, the second signal being different from the first signal, wherein the first signal is applied to a gate of the first switching element and the second signal is applied to each of gates of the second and third switching elements;

a first driving element connected to a power source, a storage capacitor, and the first, second and third switching elements; and a second driving element connected to the power source, the storage capacitor, an organic light emitting diode, and the third switching element, wherein a gate of the first driving element is directly connected to a node between a drain of the second switching element and a source of the third switching element, wherein a source of the first driving element is connected to the power source, and a drain of the first driving element is connected to a node between the first and second switching elements, and wherein each of the first and second driving elements is directly connected to the power source.

2. The device of claim 1, wherein the first switching element is turned off after the second and third switching elements are turned off.

3. The device of claim 1, wherein the first and second driving elements include p-type metal oxide semiconductor (PMOS) transistors.

4. The device of claim 1, wherein the first, second, and third switching elements include p-type metal oxide semiconductor (PMOS) transistors.

5. The device of claim 1, wherein the first and second driving elements include n-type metal oxide semiconductor (NMOS) transistors.

6. The device of claim 1, wherein the first, second, and third switching elements include n-type metal oxide semiconductor (NMOS) transistors.

7. The device of claim 1, wherein an output of the third switching element flows into a gate of the second driving element.

8. The device of claim 1, wherein the first and second driving elements form a current mirror circuit.

9. The device of claim 1, wherein the first switching element connects to a data signal source.

10. The device of claim 1, wherein when the first, second, and third switching elements are turned off, a gate voltage at the first driving element is substantially the same as a gate voltage at the second driving element.

11. The device of claim 1, wherein when the first, second, and third switching elements are turned off, a gate of the first driving element is floated.

12. An organic electro luminescence device, comprising:

power and data lines;

a first driving TFT directly connected to the power line;

a second driving TFT directly connected to the power line;

an organic light emitting diode connected to the second driving TFT;

a first switching TFT connected to the data line;

a second switching TFT connected to the first switching TFT and the first driving TFT;

a third switching TFT connected to the second switching TFT, the first driving TFT, and the second driving TFT, wherein a gate of the first driving TFT is directly connected to a node between a drain of the second switching TFT and a source of the third switching TFT, a source of the first driving TFT is connected to the power line, and a drain of the first driving TFT is connected to a node between the first and second switching TFTs;

a storage capacitor connected between the power line and the third switching TFT;

a first scan line connected to a gate of the first switching TFT; and a second scan line connected to each of gates of the second switching TFT and the third switching TFT.

13. The device of claim 12, wherein the first switching TFT is turned off after the second and third switching TFTs are turned off.

14. The device of claim 12, wherein the first and second driving TFTs include p-type metal oxide semiconductor (PMOS) transistors.

15. The device of claim 12, wherein the first, second, and third switching TFTs include p-type metal oxide semiconductor (PMOS) transistors.

16. The device of claim 12, wherein an output of the second switching TFT flows into a gate of the first driving TFT.

17. The device of claim 12, wherein an output of the third switching TFT flows into a gate of the second driving TFT.

18. The device of claim 12, wherein the first and second driving TFTs form a current mirror circuit.

19. The device of claim 12, wherein when the first, second, and third switching TFTs are turned off, a gate of the first driving TFT is floated.

* * * * *